United States Patent [19]

Thurmond, Jr.

[11] 4,169,581

[45] Oct. 2, 1979

[54] TRAILER STABILIZING JACK

[75] Inventor: Elmer T. Thurmond, Jr., Miami, Fla.

[73] Assignee: Equipment Company of America, Hialeah, Fla.

[21] Appl. No.: 917,605

[22] Filed: Jun. 21, 1978

[51] Int. Cl.[2] ..... B66F 7/26

[52] U.S. Cl. ..... 254/45; 254/101

[58] Field of Search ..... 254/45, 98, 99, 100, 254/101, 103, 92

[56] References Cited

U.S. PATENT DOCUMENTS

| | | | |
|---|---|---|---|
| 1,701,122 | 2/1929 | Ridgeway | 254/101 |
| 3,074,693 | 1/1963 | Shumake | 254/98 |
| 3,314,655 | 4/1967 | Steele | 254/45 |
| 3,415,490 | 12/1968 | Steele | 254/45 |

*Primary Examiner*—Robert C. Watson

*Attorney, Agent, or Firm*—Cullen, Sloman, Cantor, Grauer, Scott & Rutherford

[57] ABSTRACT

A stabilizing jack for helping to safely load and unload trailers. The jack consists of component parts which are easily assembled and disassembled. The jack comprises a base having an upwardly opening axially extending tubular socket, a head axially spaced above the base and having a downwardly opening axially extending tubular socket and an elongated axially extending tubular column having opposed end portions received in the sockets of the base and the head. Different lengths of column may be used with the same head and base depending on the particular usage to which the jack is placed. The base is provided with wheels and has a socket adapted to carry a long handle so as to tilt the jack back onto the wheels of the base for easy maneuverability. The head is provided with a pair of hand grips for assisting in the maneuverability of the jack under the trailer. The head includes an internally threaded axially extending bore which carries a vertically movable jack screw assembly, the outer end of which is provided with a load plate mounted for universal movement and engageable with the trailer. A pawl and ratchet mechanism is carried by the jack screw assembly whereby rotation of the jack screw in one direction is effective to raise the jack screw assembly and load plate and is effective upon rotation in the opposite direction to lower the jack screw assembly and the load plate. The head and base are each removably connected to the column by a plurality of removable threaded fasteners which permit replacement, repair and/or modification of the component parts of the stabilizing jack.

10 Claims, 4 Drawing Figures

TRAILER STABILIZING JACK

BACKGROUND OF THE INVENTION

When a trailer from a tractor-trailer rig is being loaded or unloaded at a dock area or the like, the tractor (which will pull or has pulled the trailer) is not normally connected to it. The landing gear of the trailer is lowered to support the front end thereof when the tractor is disconnected. Consequently, the trailer is susceptible to collapse of the trailer landing gear, shifting because of sitting on unlevel ground, and tipping due to loading or unloading by heavy equipment. In order to load and unload the trailer safely, some form of stabilizing device under the trailer front end is required.

Safety devices for use in the environment of the present invention must be maneuverable and easy to operate or they may not be used at all. In the case of a trailer at an unloading or loading dock, an additional problem exists. If the stabilizing device is not maneuverable and easy to operate, the trailer occupies valuable dock space longer than can be tolerated or economically justified. In addition, when a trailer is disconnected from a tractor and the landing gear is down, the trailer front end is several feet from ground level. Normal stabilizing apparatus such as blocks or small hydraulic jacks are not appropriate. The device for stabilizing a trailer front end must be capable of holding substantial loads and in addition be maneuverable into position under the elevated trailer front end. Finally, the jack must be easy to operate.

In order to provide for long operating life, the component parts of the stabilizing jack must be easily assembled and disassembled to permit replacement, repair, maintenance and/or modification of the component parts of the jack.

SUMMARY OF THE INVENTION

The trailer stabilizing jack is easily maneuverable into position under the front end of the trailer. The jack includes relatively few component parts which are constructed and arranged in a manner which facilitates replacement, repair, maintenance and/or modification of the component parts of the stabilizing jack when required.

It is a feature of the present invention to provide a jack having a longitudinal axis comprising a base having an upwardly opening tubular socket, a head axially spaced above the base and having a downwardly opening tubular socket, with the head including an internally threaded bore which is axially aligned with and intersects the downwardly opening socket and an elongated axially extending tubular column having opposing end portions received in the sockets of the base and the head. With such a construction removable fastening means are provided at the opposite ends of the column for securing the base and the head to the column. With such a construction the fastening means at opposite ends of the column can be easily removed to facilitate replacement, repair, maintenance and/or modification of the component parts of the stabilizing jack.

It is a further feature of the present invention to provide a stabilizing jack of the aforementioned type wherein an axially extending jack screw assembly having upper and lower portions is threadedly carried by the head and comprises a tubular externally threaded screw member and a generally solid core member which extends through and has a length greater than the screw member. The screw and core members have inner and outer ends with a stop plate being located within the column abutting the inner ends of the screw and core members and being secured to the core members. With such a construction the screw member is threadedly mounted in the threaded bore of the head for axial movement whereby the screw member and the core member move together as a unit relative to the tubular column and the head. Such core member has a load plate adjustably secured thereto which is adapted to engage the trailer.

A still further feature of the present invention is to provide a stabilizing jack of the aforementioned type wherein a pawl and ratchet mechanism is carried by the core member in the space between the top surface of the screw member and the load plate for rotating the screw member in opposite directions relative to the head and thereby raising or lowering the core member and the load plate.

Another feature of the present invention is to provide a stabilizing jack of the aforementioned type wherein the column of one length may be replaced by a column of another length in order to have available jacks of different heights as the job requires.

Still another feature of the present invention is to provide a stabilizing jack of the aforementioned type wherein the head is provided with a pair of generally radially extending integral handles for use in maneuvering the stabilizing jack into position under a trailer.

A further feature of the present invention is to provide a stabilizing jack of the aforementioned type wherein the head includes an internal wall between the threaded bore and the socket, with the stop plate being engageable with the internal wall of the downwardly opening socket to prevent the jack screw assembly from separating from the head.

Another feature of the present invention resides in the jack load mounting plate. The standard load plate is mounted for universal motion on one end of the ratchet screw assembly. If it is desired that the load be spread over a larger area, an additional oversized load plate is available that easily slips over the standard load plate.

Still another feature of the present invention is to provide a stabilizing jack that is simple in construction, easy to assemble and disassemble, efficient in operation and is economical to operate and maintain.

For other objects and for a better understanding of the present invention, reference is made to the followed detailed description of the invention in conjunction with the drawings.

DETAILED DESCRIPTION OF A PREFERRED EMBODIMENT

Figure 1:
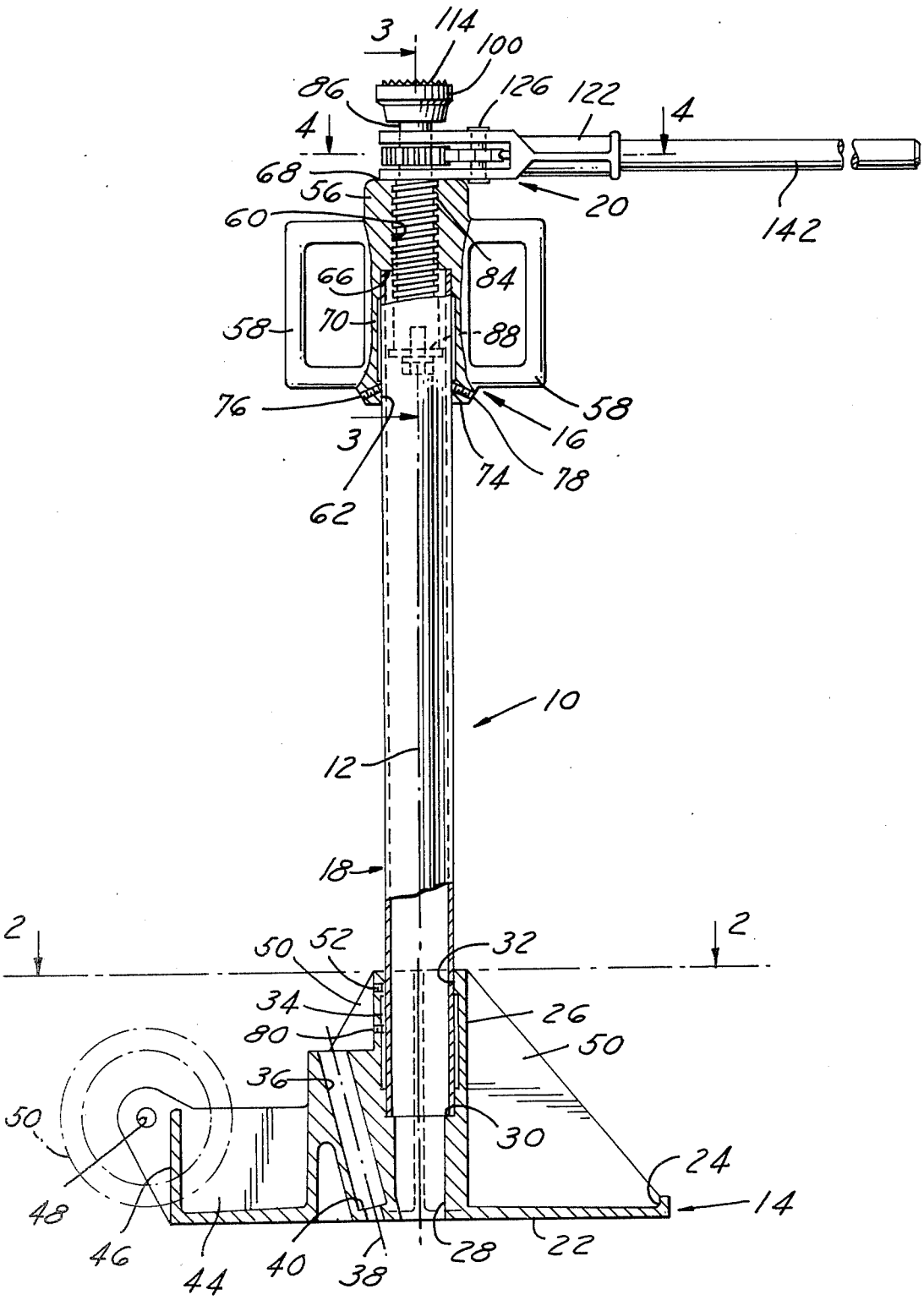
FIG. 1 is a side elevation view of the stabilizing jack with portions cut away for interior viewing.

The trailer stabilizing jack is designated in the drawings by the numeral 10 and has a longitudinal vertical axis 12. The jack comprises a base 14, a head 16 spaced vertically above the base 14 along axis 12, a tubular column 18 interposed between the base 14 and head 16 and finally a vertically movable jack screw mechanism or assembly 20.

Figure 2:
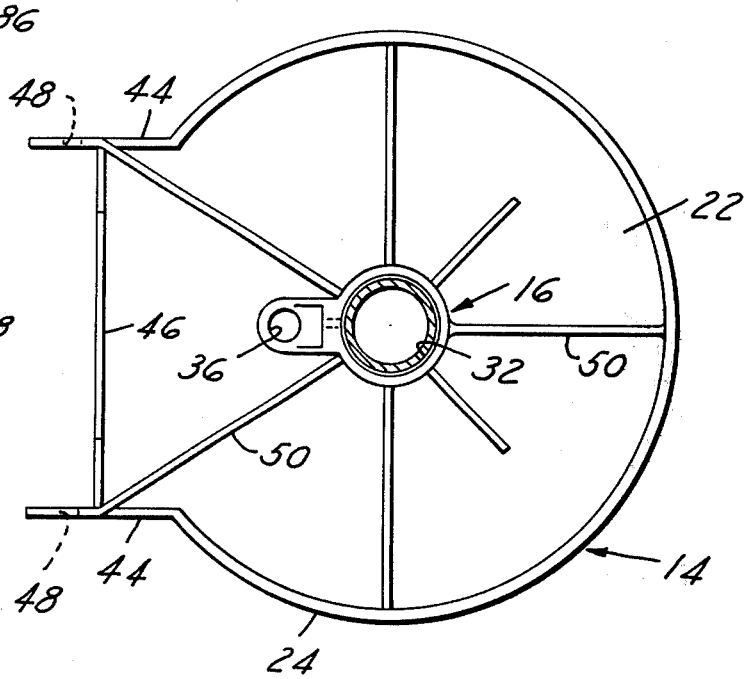
FIG. 2 is a top cross-sectional view of the stabilizing jack base viewed in the direction of arrows 2—2 of FIG. 1.

The base 14 has a generally horizontally extending bottom portion or base plate 22 provided with an annular upstanding rim 24 which extends for more than 180° as best illustrated in FIG. 2. The base 14 further includes a centrally located upstanding tubular sleeve 26 having a bore 28 which extends from one end of the sleeve 26 to the other end as best illustrated in FIG. 1. The upper end portion of the bore 28 is larger in diameter than the lower end portion of bore 28. Such end portions are separated by an annular shoulder 30, with the upper end portion of the bore 28 above the surface 30 forming an upwardly opening tubular socket 32. The socket 32 has upper and lower annular bearing areas, with the annular portion 34 between the bearing areas being greater in diameter so as not to contact the column 18 as shown in FIG. 1.

The base 14 further includes a through hole or tubular socket 36 having an axis 38 which is inclined to the vertical axis 12 of the stabilizing jack 10 as noted in FIG. 1. The socket 36 has an annular shoulder 40 near but spaced from the lower end of bore 36 which is of a smaller diameter than the remaining portion of bore 36. A long handle, not shown, primarily intended for use in actuating the jack screw mechanism 20, may be inserted and stored in the hole 36 of the base 14, with the inner end of the handle in engagement with shoulder 40. The handle may also be used to facilitate the moving of the jack screw assembly 20 as will subsequently appear.

The base 14 further includes a pair of spaced apart parallel flanges or brackets 44 which are connected to the opposite ends of the annular upstanding rim 24 as best illustrated in FIG. 2. The flanges 44 each has a height substantially greater than the height of the rim 24 and are connected by an upstanding wall or element 46. The outer ends of the flanges 44 are provided with openings 48 which are adapted to receive opposing ends of an elongated axle, not shown as is well known in the art. The axle is designed to carry a pair of ground engaging wheels represented by the dotted lines 50 in FIG. 1. The handle may be inserted into the socket 36 of the stabilizing jack base 14 and a force applied thereto to tilt the jack 10, raise the front edge of the base 14 and thereby support the entire jack 10 on the wheels 50. Thereafter the jack 10 may be maneuvered to any desired location.

The base 22 is further provided with a series of upstanding ribs or gussets 50 which extend generally radially from the axis 12 as best illustrated in FIGS. 1 and 2. The ribs 50 may be of different lengths and extend from the area of the tubular sleeve 16 to the rim 24. The purpose of the ribs 50 is to reinforce the vertical sleeve 26 and the base plate 22.

The jack base casting 14 is further provided with a pair of vertically spaced apart threaded openings 52 (FIG. 1) which are provided in the tubular sleeve 26 and are adapted to receive set screws for retaining the column 18 in the base 14 as will subsequently be described. The openings 52 extend through the wall thickness of the sleeve 26.

The annular cast jack head 16 includes an annular sleeve 56 having a pair of generally radially extending handles 58. The sleeve 56 has an axis concentric with axis 12 and is divided into an annular threaded upper bore 60 and a non-threaded lower tubular bore or socket 62 which is of a diameter larger than the diameter of the threaded bore 60. The threaded bore 60 and the downwardly opening socket 62 are separated by an annular shoulder 66. The sleeve 56 includes a generally flat top or upper surface 68 which is parallel to the annular shoulder 66. The non-threaded downwardly opening socket 62 has upper and lower annular bearing portions which are spaced apart by an annular non-bearing portion 70 which is greater in diameter than the upper and lower bearing portions so as not to contact the upper end of the column 18 as shown in FIG. 1.

The bottom portion 74 of the tubular sleeve 56 is provided with a pair of threaded openings 76 each having an axis which is inclined to the main axis 12 and is adapted to receive a threaded fastener.

The tubular column 18 may be of any suitable length, as an example, from 1 foot to 10 feet depending upon the particular use to which the stabilizing jack 10 is placed. The upper end of the column 18 is received in the downwardly opening socket or recess 62 of the jack head 16 and engages the annular shoulder 66. Threaded fasteners 78 are screw threaded in the threaded openings 76 so as to retain the jack head 16 in a fixed position on the column 18. The lower end of the column 18 is inserted into the upwardly opening socket 32, with the lower end surface engaging the annular shoulder 30. Threaded fasteners 80 are inserted into the threaded openings 52 to retain the column 18 on the jack base 14.

The head 16 and base 14 may be removed from column 18 by first removing threaded fasteners 78, 80. Thereafter the component parts of the jack assembly 10 may be repaired or replaced or a column 18 of a different length assembled with the existing head 16 and base 14 as noted previously.

Figure 3:
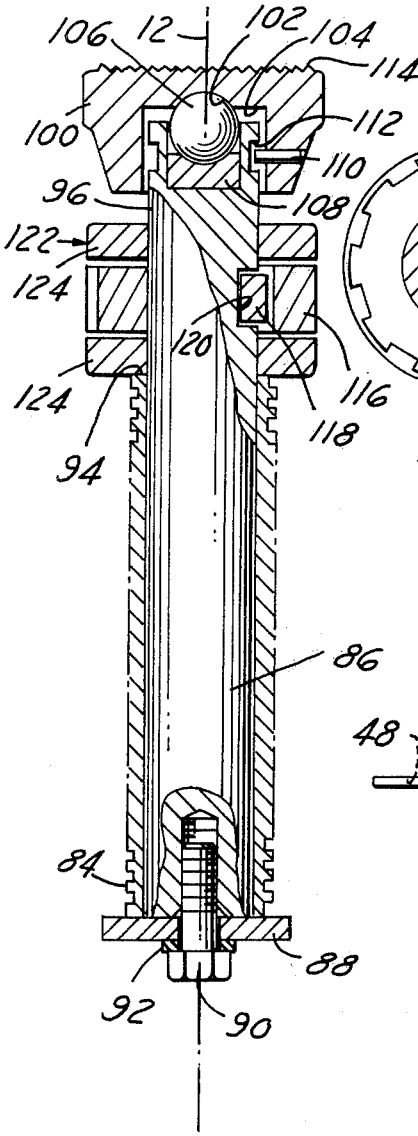
FIG. 3 is a partial cross-sectional view of the ratchet-screw assembly viewed in the direction of arrows 3—3 of FIG. 1.

The threaded bore 60 of the jack head 16 carries the jack screw mechanism 20. The jack screw assembly 20 includes a tubular externally threaded screw member 84 and a generally solid core member 86 which extends through and has a length greater than the length of the screw member 84. The screw and core members 84, 86 have inner and outer ends. A stop plate 88 is located within the column 18 (FIG. 1) and abuts the inner ends of the screw member 84 and the core member 86 as shown in FIG. 3. A threaded fastener 90 extends through the stop plate 88 into the interior of the core member 86 so as to secure the stop plate 88 thereto. A washer 92 is provided between the head of fastener 90 and the stop plate 88.

The screw member 84 is threadedly mounted in the threaded bore 60 of the head 16 for vertical axial movement whereby the screw member 84 and the core member 86 vertically move together as a unit relative to the tubular column 18 and the head 16. The core member 86 has its outer end extending above and being spaced from the top surface 68 of the tubular sleeve 56 and from the top surface 94 of the screw member 84. The upper portion of the solid core member 86 extending upwardly above the top surface 94 of screw member 84 is designated by the numeral 96 in FIG. 3.

Figure 4:
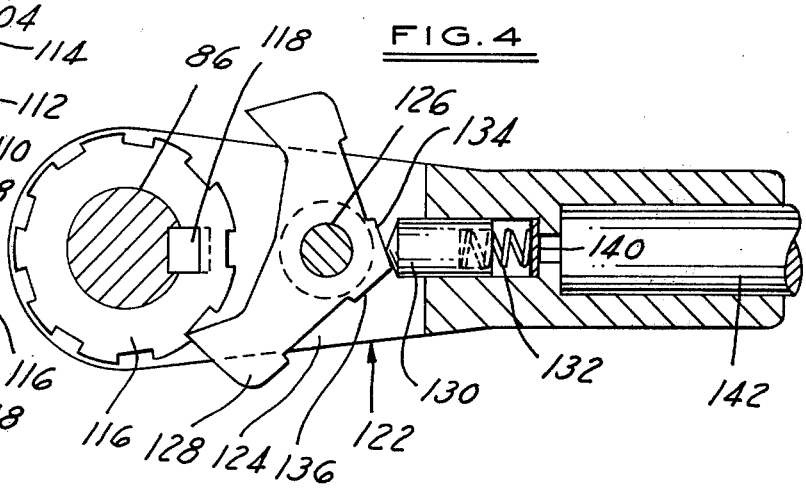
FIG. 4 is a cross-sectional view of the ratchet handle assembly viewed in the direction of arrows 4—4 of FIG. 1.

Referring to FIGS. 3 and 4, the ratchet-screw assembly or jack screw mechanism 20 of the present invention is shown. Mounted on upper portion 96 of the core member 86 is a stabilizing jack cap 100. The jack cap 100 has a depression 102 in its bottom surface 104 that rests on a hardened alloy steel ball 106. The ball 106, in turn, is seated in a ball seat 108 provided on the upper end of the core member 86. Several roller pins 110 are press fit into cap 100 and ride in an annular groove 112 provided in the core member 86 as shown in FIG. 3. The cap 100 is mounted for universal movement so that it may rotate around groove 112 and pivot about ball 106. Cap 100 also has a plurality of upwardly extending cone-shaped projections 114 on its load-bearing surface. An optional oversize cap (not shown) may be slipped over the standard jack cap 100 for distributing the load over a larger area. The optional cap would be held in place on the standard cap 100 by hardened steel screws, not shown. Either cap 100 or the optional oversized cap accommodates up to 9° tilt from horizontal due to the universal mounting.

A ratchet wheel 116 is mounted on the core member 86 by a key 118 and keyway 120. A ratchet handle 122 is rotatably mounted on the core member 86. As shown in FIG. 3, the ratchet handle 122 has a pair of upper and lower arm portions 124 sandwiching or located on opposite sides of the ratchet wheel 116. Both the ratchet wheel 116 and ratchet handle 122 are pivotally mounted on the unthreaded upper portion 96 of the core member 86.

FIG. 4 is a cross-sectional view of the ratchet handle assembly as shown in FIG. 3. Pivotally mounted to ratchet handle 122 by a rivet 126 is a pawl 128. Detent pin 130 is tapered at one end for engagement with either of the pawl's surfaces 134 or 136 and it has an opening at its other end for receiving one end of the spring 132. Spring 132 pushes against spring stop 140 and thereby spring biases detent pin 130 against the pawl 128. To obtain additional torque, a long handle 142 may be inserted into the outer end of the ratchet handle 122. The long handle 142 may be inserted into one end of the ratchet handle 122. The long handle 142 may be stored in tubular socket 36 of base 14 as mentioned previously.

In operation, with the pawl 128 in the position shown in FIG. 4, the ratchet handle 122 may be rotated clockwise thereby turning ratchet wheel 116 and core member 86 with it. The pawl 128 is pivoted manually from a position as shown in FIG. 4 to a position where detent pin 130 abuts surface 136 of pawl 128. The geometry of the elements in either position prevents the pawl 128 from yielding. There is no turning moment on pawl 128 because rivet 126 takes the load. The lower portion of the screw and core member assembly 84, 86 is threadingly engaged with the threaded portion of the cylindrical head 16. Clockwise rotation of the ratchet-screw assembly will cause the screw 84 and core 86 to move downward into the cylindrical column 19 thus lowering cap 100. If the pawl 128 is moved from the position shown in FIG. 4 to a position whereby the detent pin 130 is engaged against the surface 136 of the pawl 128, the ratchet handle 122 may be rotated in a counterclockwise direction thereby moving the ratchet-screw assembly out of column 18 and urging the cap 100 against the underside of a trailer front-end.

This invention may be further developed within the scope of the following claims. Accordingly, the above specification is to be interpreted as illustrative of only a single operative embodiment of the present invention, and not in a strictly limited sense.

What is claimed is:

1. A stabilizing jack having a longitudinal vertical axis comprising a base having an upwardly opening axially extending tubular socket, a head axially spaced above said base and having a downwardly opening axially extending tubular socket, said head including an internally threaded bore which is axially aligned with and intersects said downwardly opening socket, an elongated axially extending tubular column having opposing end portions received in the sockets of said base and said head, fastening means at opposite ends of said column for securing said base and said head to said column, an axially extending jack screw assembly having upper and lower portions, said assembly being threadedly carried by said head and having its lower portion axially movable within said column, said jack screw assembly comprising a tubular externally threaded screw member and a generally solid core member which extends through and has a length greater than said screw member, said screw and core members having inner and outer ends, a stop plate located within said column abutting the inner ends of said screw and core members and being secured to said core member, said screw member being threadedly mounted in the threaded bore of said head for axial movement whereby said screw member and said core member move together as a unit relative to said tubular column and said head, said core member having its outer end extending above and being spaced from the top surface of said screw member, a load plate, means for adjustably securing said load plate to the outer end of said core member, and a ratchet and pawl mechanism carried by said core member in the space between the top surface of said screw member and said load plate for rotating said screw member in opposite directions relative to said head and thereby raising or lowering said core member and said load plate.

2. The stabilizing jack defined in claim 1 wherein said fastening means at opposite ends of said column for securing said base and said head to said column are removable to permit replacement, repair and/or modification, of the component parts of the stabilizing jack.

3. The stabilizing jack defined in claim 2 wherein said removable fastening means are in the form of threaded fasteners carried by said head and by said base respectively, each fastener having its inner end in tight engagement with the outer surface of said column.

4. The stabilizing jack defined in claim 1 wherein said head is provided with a pair of generally radially extending integral handles for use in maneuvering said stabilizing jack into position under a trailer.

5. The stabilizing jack defined in claim 1 wherein said head includes an internal wall between said threaded bore and said socket, said stop plate being engageable with said internal wall of said downwardly opening socket to prevent said jack screw assembly from separating from said head.

6. The stabilizing jack defined in claim 1 wherein said ratchet and pawl mechanism includes a ratchet wheel mounted on the outer end of said core member exteriorly of said head and column, a handle structure having one end carried by said core member adjacent said ratchet wheel, a two-position pawl carried by said handle structure for engagement with said ratchet wheel whereby said pawl is in its first position rotational movement of said handle structure in one direction will move said jack screw assembly into said column thus lowering said load plate and when said pawl is in its second position rotational movement of said handle structure in the other direction will move said jack screw assembly out of said column thus raising said load plate.

7. The stabilizing jack defined in claim 1 wherein said ratchet and pawl mechanism includes a ratchet wheel mounted on said core member spaced from the outer end thereof, a handle pivotally mounted on said core member with portions on each side of said ratchet wheel, a pawl pivotally carried by said handle for transferring the rotation of said handle to said ratchet wheel, said core member and said screw member, whereby when said handle is rotated in a first direction said jack screw assembly moves into said column and when said handle is rotated in a second direction said jack screw assembly moves out of said column.

8. The stabilizing jack defined in claim 1 wherein said means provided for securing said load plate to said core member includes a ball and ball seat mounted together on said outer end of said core member, a groove provided in the outer end of said core member, said load plate contacting said ball and having a pin mounted thereon for movement in said groove.

9. The stabilizing jack defined in claim 1 wherein a second oversized load plate is secured to said first mentioned load plate whereby the load borne by said stabilizing jack is distributed over a larger area.

10. The stabilizing jack defined in claim 7 wherein a detent pin carried by said handle engages at least one surface of said pawl, said detent pin having means for biasing it against said pawl.

* * * * *